US006595863B2

(12) United States Patent
Chamberlain et al.

(10) Patent No.: US 6,595,863 B2
(45) Date of Patent: Jul. 22, 2003

(54) GOLF SIMULATOR

(75) Inventors: Stephen B. Chamberlain, Louisville, KY (US); Charles W. Playforth, Louisville, KY (US); John C. Pfeiffer, Louisville, KY (US); James R. Kaiser, Louisville, KY (US)

(73) Assignee: Par Action Golf, Inc., Louisville, KY (US)

( * ) Notice: Subject to any disclaimer, the term of this patent is extended or adjusted under 35 U.S.C. 154(b) by 93 days.

(21) Appl. No.: 09/766,294

(22) Filed: Jan. 19, 2001

(65) Prior Publication Data

US 2003/0040373 A1 Feb. 27, 2003

Related U.S. Application Data

(63) Continuation-in-part of application No. 09/678,001, filed on Oct. 3, 2000.

(51) Int. Cl.[7] ..... A63B 57/00

(52) U.S. Cl. ..... 473/132; 473/133; 473/135; 473/134; 473/136; 273/461; 273/317.1; 273/317.2

(58) Field of Search ..... 473/132, 131, 473/134, 135, 136, 140, 151, 152, 163, 166, 185, 180, 182, 209, 387, 168, 169, 176, 133, 150–171; 273/317.1, 317.2, 108, 108.1, 108.2; 463/1, 2, 3, 49

(56) References Cited

U.S. PATENT DOCUMENTS

| | | | | |
|---|---|---|---|---|
| 1,779,540 A | | 10/1930 | Haynes | |
| 2,051,253 A | | 8/1936 | Goehler et al. | |
| 2,530,698 A | | 11/1950 | Hogeberg | |
| 2,618,480 A | | 11/1952 | Williams | |
| 2,643,883 A | | 6/1953 | Hogeberg | |
| 3,112,932 A | | 12/1963 | Marsh | |
| 3,294,402 A | | 12/1966 | Scott | |
| 3,298,694 A | | 1/1967 | Turnau et al. | |
| 3,378,263 A | | 4/1968 | Turnau et al. | |
| 3,559,996 A | | 2/1971 | Hopp | |
| 3,563,553 A | | 2/1971 | Baldwin et al. | |
| 3,589,732 A | | 6/1971 | Russell et al. | |
| 3,591,184 A | | 7/1971 | Conklin et al. | |
| 3,599,980 A | * | 8/1971 | Harmond et al. | 473/153 |
| 3,602,506 A | * | 8/1971 | Gentiluomo | 273/DIG. 8 |
| 3,643,959 A | | 2/1972 | Cornell et al. | |
| 3,649,025 A | * | 3/1972 | Garland | 273/350 |
| 3,695,619 A | * | 10/1972 | Brobston | 473/169 |
| 3,708,173 A | * | 1/1973 | Hewson, Jr. | 473/153 |
| 3,712,624 A | | 1/1973 | Conklin | |
| 3,719,361 A | * | 3/1973 | Rotolo | 473/169 |
| 3,729,315 A | | 4/1973 | Conklin et al. | |
| 3,756,606 A | | 9/1973 | Land | |
| 3,769,894 A | | 11/1973 | Conklin | |
| 4,113,260 A | * | 9/1978 | Sain | 273/141 R |
| 4,129,300 A | * | 12/1978 | Magnuson | 473/169 |

(List continued on next page.)

*Primary Examiner*—Valencia Martin-Wallace
*Assistant Examiner*—Yveste G Cherubin
(74) *Attorney, Agent, or Firm*—James E. Cole; Jeffrey A. Haeberlin; Middleton Reutlinger

(57) ABSTRACT

A golf simulator has a flooring system comprising a tee area, a green area, a green-side area and a ball feed system adjacent the flooring system. From measurements taken when the ball is hit, the computer control system computes the next shot position of the ball after it is hit and the corresponding location on the flooring system. A ball feed system collects the ball into a ball feed chute and moves the ball toward a return gutter. When the ball contacts a gutter sensor, the sensor signals a gutter door to open, corresponding to a feed tube. The ball is sent down the return gutter and drops, at the position where the gutter door opened, into a feeding tube and a ball lifting mechanism positions a ball at the appropriate location on the flooring system. This process continues until a player finishes the hole. Accordingly, a player need not touch the golf ball, except when under penalty, more similar to an actual round of golf.

22 Claims, 11 Drawing Sheets

U.S. PATENT DOCUMENTS 4,160,942 A 7/1979 Lynch et al.
4,177,994 A 12/1979 Lindquist
4,437,672 A 3/1984 Armantrout et al.
4,836,551 A 6/1989 LaSalle
4,872,686 A * 10/1989 Trasko ..... 473/169
4,995,607 A 2/1991 Whitfield
5,016,886 A 5/1991 Gould
5,020,802 A 6/1991 af Strron
5,024,441 A 6/1991 Rousseau
5,033,745 A 7/1991 Sullivan et al.
5,052,688 A 10/1991 Shiau
5,056,791 A 10/1991 Poillon et al.
5,092,600 A * 3/1992 Ruth, Jr. et al. ..... 473/168
5,221,082 A 6/1993 Curchod
5,265,875 A * 11/1993 Fitzgerald ..... 362/431
5,282,629 A 2/1994 Eckstein
5,333,874 A 8/1994 Arnold et al.
5,351,964 A * 10/1994 Kruger ..... 473/136
5,354,063 A 10/1994 Curchod
5,390,927 A 2/1995 Angelos
5,390,931 A 2/1995 Chiasson
5,411,267 A 5/1995 Burks et al.
5,478,077 A * 12/1995 Miyahara ..... 273/372
5,513,841 A 5/1996 Takagi
5,549,517 A 8/1996 Ikemoto
5,580,320 A * 12/1996 Meikle ..... 473/160
5,603,664 A * 2/1997 Provost ..... 473/134
5,616,078 A 4/1997 Oh
5,662,526 A 9/1997 Sutherlin
5,667,222 A 9/1997 Bunyi
5,683,304 A 11/1997 Bunyi
5,779,241 A 7/1998 D'Costa et al.
5,846,139 A 12/1998 Bair et al.
5,860,648 A 1/1999 Petermeier et al.
5,901,833 A 5/1999 Yokoyama
5,916,033 A 6/1999 Doherty
5,982,352 A 11/1999 Pryor

* cited by examiner

GOLF SIMULATOR

This is a Continuation in Part of application No. 09/678,001 filed Oct. 3, 2000.

BACKGROUND OF THE INVENTION

1. Technical Field of the Invention

The present invention relates to a golf simulator and in particular a more realistic simulation in which a golf ball is automatically located on a simulator based on computed results from a prior shot. Thus, a player need not touch the golf ball in preparing to hit subsequent golf shots as in the prior art. Moreover, two or more full swing shots may be taken at various locations on the simulator depending on the computed results of the prior shot.

2. Description of the Related Art

The popularity of golf has grown steadily throughout recent history and during this period the number of golf courses has steadily increased as well. However, in recent years the popularity has exploded as younger generations have more opportunities to learn the game. Moreover, professional golf has become a popular spectator sport televised throughout the year with various figures that younger fans enjoy watching. This has significantly fueled the golfing explosion in recent years.

Although the number of golf courses has steadily increased, it has not kept pace with the growth in popularity of the game. Thus, players of all ages and skill levels struggle to find golf courses and driving ranges at which they can both play and practice. Not only are the number of golf courses too few, but players also have to deal with both daily and seasonal weather conditions which preclude play. One way of alleviating these problems has been through the use of golf simulators. Golf simulators are usually indoors and not subject to inclimate weather conditions. In addition, they allow players to both practice and play golf, as well as test equipment prior to purchase.

Throughout their development, golf simulators have increased in level of technology and realism of play. In fact many simulators can now predict the results of shots based on swing speed, initial parameters of golf ball's flight, wind conditions, course obstacles, and other simulated conditions which may arise during a golf round. However, all golf simulators have the same problems. A player is forced to retrieve their ball after hitting, return to the same position to hit the next shot, and often times go to a different location to putt.

Typically golf simulators have a tee area facing a screen upon which a projector can show various golf holes. Often the projector is connected to a computer which electronically communicates the various views necessary for projection onto the screen. The player may hit a shot into the screen at which time a computer, based on initial measurements, computes the flight of the golf ball as well as the resulting position of the golf shot. This information is then digitally relayed to the projector for projecting onto the screen. Next, the player retrieves his or her ball from the area between the tee area and the screen, and returns to the tee area for a subsequent shot.

Herein, lies the problem with current golf simulators. During an actual round of golf, a player moves to the next golf shot position of the previous shot and does not touch the golf ball between shots, unless the ball is on the green or under a penalty situation. However, current simulators require a player to retrieve the ball from near a projection screen and replace it on the tee area for hitting a subsequent shot, whereby the player is forced to pick up the golf ball.

U.S. Pat. No. 5,024,441 teaches a tee area with various surfaces that are similar to fairway, sand bunker, or rough from which a player may hit his or her ball. However, in this embodiment a player must manually place the ball on the appropriate surface for each subsequent shot.

U.S. Pat. No. 3,563,553 teaches a golf simulator having an automatic lie selection control for selecting one of a plurality of mats from which a player may hit golf balls. This indexing program corresponds to scenes of a projector projecting golf images. However, a player must still place a golf ball on the selected mat prior to hitting a subsequent shot.

U.S. Pat. No. 4,437,672 teaches a golf simulator that estimates distance traveled and ultimate resting position of a simulated golf shot. It also has various positions marked on a putting green from where a player can putt to a centrally located hole. However, the player must position the ball on one of the marks for putting as well as the tee area for hitting shots.

SUMMARY OF THE INVENTION

It is an object of the present invention to provide a golf simulator having a system for returning golf balls to a plurality of hitting locations including the tee shot tee, fairway approach shot tees, green-side tees, or green tees.

It is a further objective of this golf simulator to position a golf ball for a subsequent shot as a result of the prior shot, thus making the simulation more realistic.

A golf simulator comprising:

a flooring system having a ball travel system contained therein;

a projection system mounted adjacent said flooring system;

a computer control system adjacent said flooring system and in electronic communication with said projection system and said ball trajectory system;

said flooring system comprising a tee area adjacent a green area, a green-side area surrounding said green area, and a ball feed system adjacent said flooring system;

said tee area comprising a tee shot tee and at least one fairway approach shot tee;

said green area comprising a plurality of putting tees and at least one putting hole;

said green side area containing a plurality of chip shot tees;

said ball feed system comprising a ball return chute adjacent a flooring system and connected to a return gutter, said return gutter being disposed the length of, and adjacent to, said flooring system, said return gutter having a plurality of feeding tubes depending therefrom, each of said plurality of feeding tubes feeding a ball lift mechanism, said ball lift mechanisms being located beneath said flooring system;

each ball lifting mechanism comprising:

a housing, said housing comprising a ball entrance depending from said feeding tubes, a vertically hollowed area within said housing accepting balls;

a tee, said tee positioned within said vertically hollowed area whereby said tee moves from beneath said ball entrance to said ball exit;

A tee rail, said tee rail slidably connected to said tee whereby the tee maintains correct alignment during movement in said vertically hollowed area;

a ball entrance gate located adjacent said ball entrance, said ball entrance gate being spring biased and pivotably attached to said housing;

a linkage having first and second ends, said first end slidably connected to said tee, said linkage also being pivotably connected to said housing;

a guide rod having first and second ends, said first end connected to an actuator, said second end having a spring seat, said spring disposed between said spring seat and said slidable connection to said second end of said linkage;

said linkage being spring biased whereby said second end of linkage is normally positioned lower than said first end of linkage thereby positioning said tee at said ball exit;

said projection system comprising a projector located adjacent said flooring system and a projection screen opposite said tee area;

a computer control system comprising a projector control module, a ball trajectory module, a ball feed system control module, and a game button response module;

said projector control module disposed within said computer control system comprising an interface for said projector, control software and hardware, and at least one wire connecting said projector and said projector control module for electronic communication therebetween;

said ball trajectory measuring module comprising an interface disposed within said computer control system in electronic communication with a ball trajectory system;

said ball trajectory system comprising a plurality of ball hit detectors located within each of said green tees, green side tees, fairway approach shot tees, and said tee shot tees, and a sensing grid detector located opposite said tee area substantially adjacent said projection screen;

said game button response module, electronically connected to said computer control system, comprising a course select button, a number of putts taken button, and a penalty stroke button.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
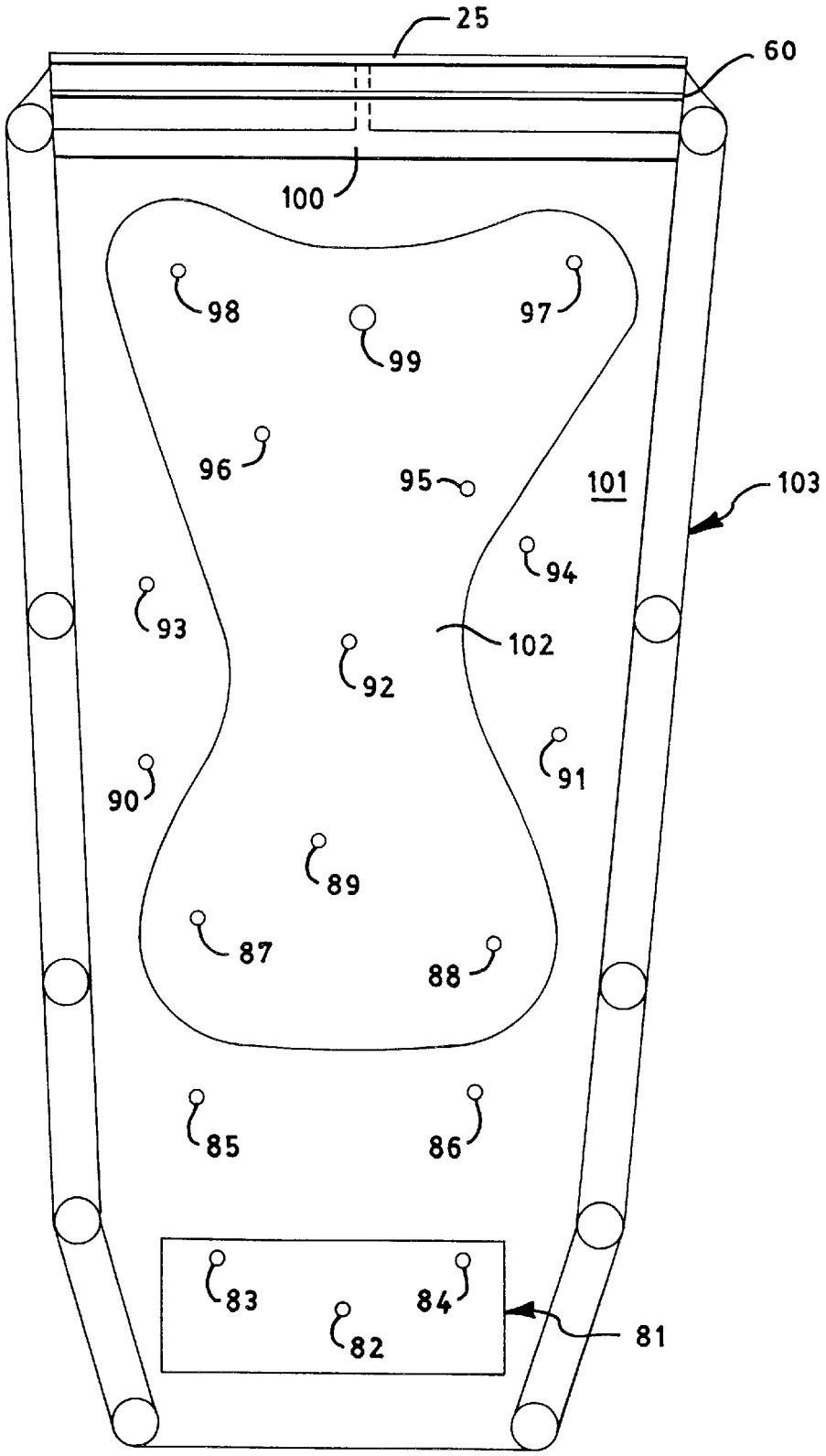
FIG. 1 is a plan view of the golf simulator.

Referring initially to FIG. 1, a golf simulator according to its preferred embodiment is shown from a plan view. The flooring system 103 is comprised of a tee area 81, green area 102, and a green-side area 101 surrounding the green area. At one end of the simulator flooring system 103 is a tee area 81 for hitting tee shots from a tee shot tee 82 and approach shots from fairway approach shot tees 83 and 84 on a simulated golf hole. The green area 102 is comprised of a putting surface containing various putting tees 87, 88, 89, 92, 95, 96, 97, and 98, as well as a putting hole 99. The tee shot tee 82, fairway approach shot tees 83, 84 chip shot tees 85, 86, 90, 93, 91, 94 and putting tees 87, 88, 89, 92, 95, 96, 97, 98 are respectively contained within the flooring system 103 and are of varying length dependent upon the location of the tee. For example a tee shot tee is of a length which elevates a ball above the level of the flooring system 103 whereas fairway approach shot tees 83, 84, chip shot tees 85, 86, 90, 91, 93, 94, and putting tees 87, 88, 89, 92, 95, 96, 97, 98 are substantially at the same level as the surface of the flooring system 103.

In one embodiment the green area 102 has an hourglass shape, however one skilled in the art will recognize that the shape of the green area may be changed to any suitable shape within the boundaries of the golf simulator. The golf green may also be fully adjustable such that various undulations can be added and changed for each hole played.

Surrounding the green area 102 is the green-side area 101 comprised of a plurality of chip shot tee holes, 85, 86, 90, 91, 93, 94 for chipping onto the green area 102. This embodiment shows two chip shot tees on each of three sides of the green area 102. However, this embodiment is not meant to be a limitation as any number of chip shot tees can be located on any side of the green area 102.

Figure 4:
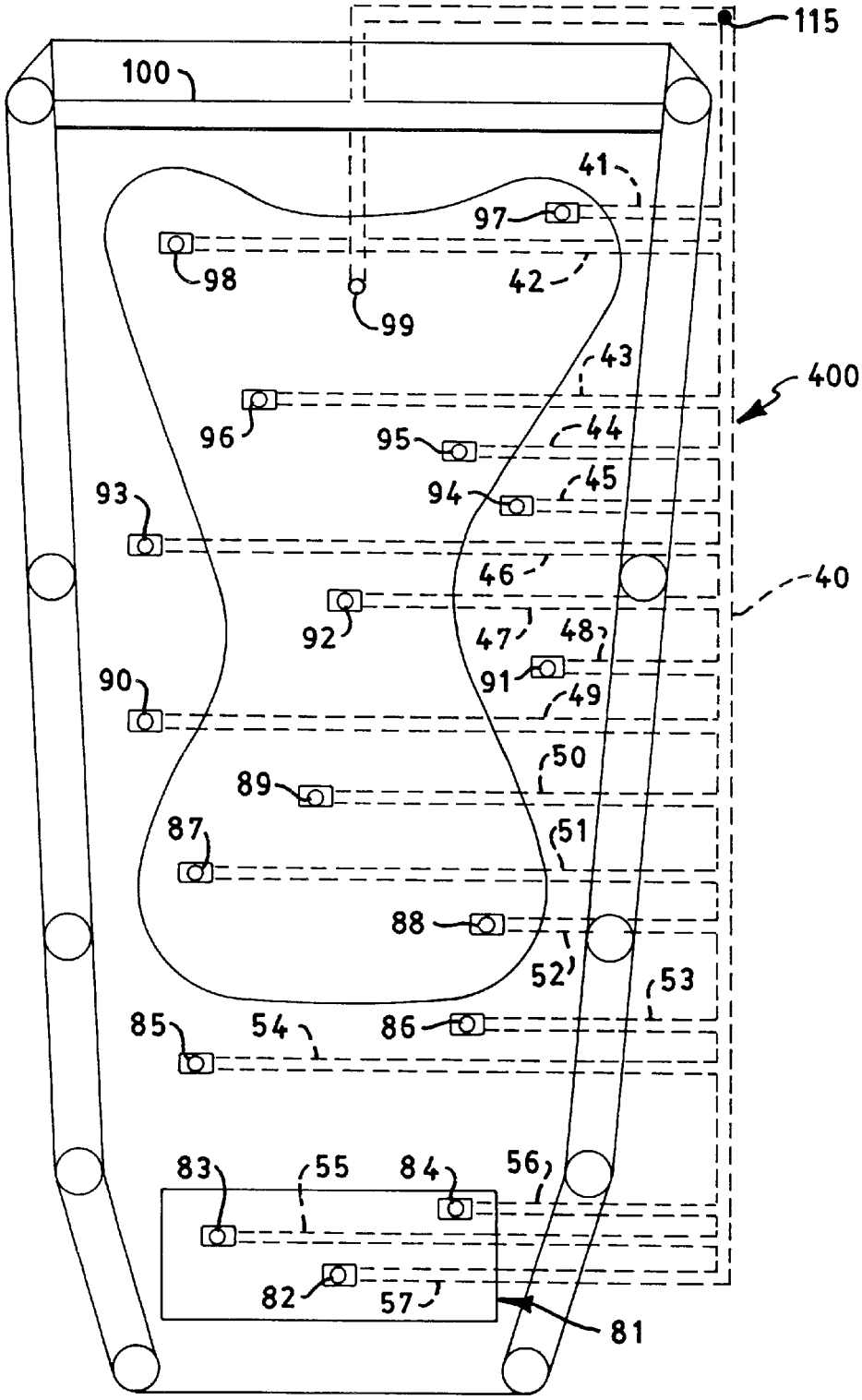
FIG. 4 is a plan view of the flooring area showing the feeding tubes.

Also located adjacent the green area 102 and green-side area 101 is the ball feed system 400 as shown in FIG. 4. The ball feed system 400 is comprised of a ball return chute 100 which catches balls that are hit by a player and directs them throughout the flooring system 103, using a plurality of feeding tubes 41, 42, 43, 44, 45, 46, 47, 48, 49, 50, 51, 52, 53, 54, 55, 56, 57 to an appropriate tee for subsequent shot by the player.

FIG. 1 also shows the sensing grid detector 60 adjacent the projection screen 25. The sensing grid detector 60 communicates with the computer control system 26 and will be discussed more thoroughly below.

Figure 2:
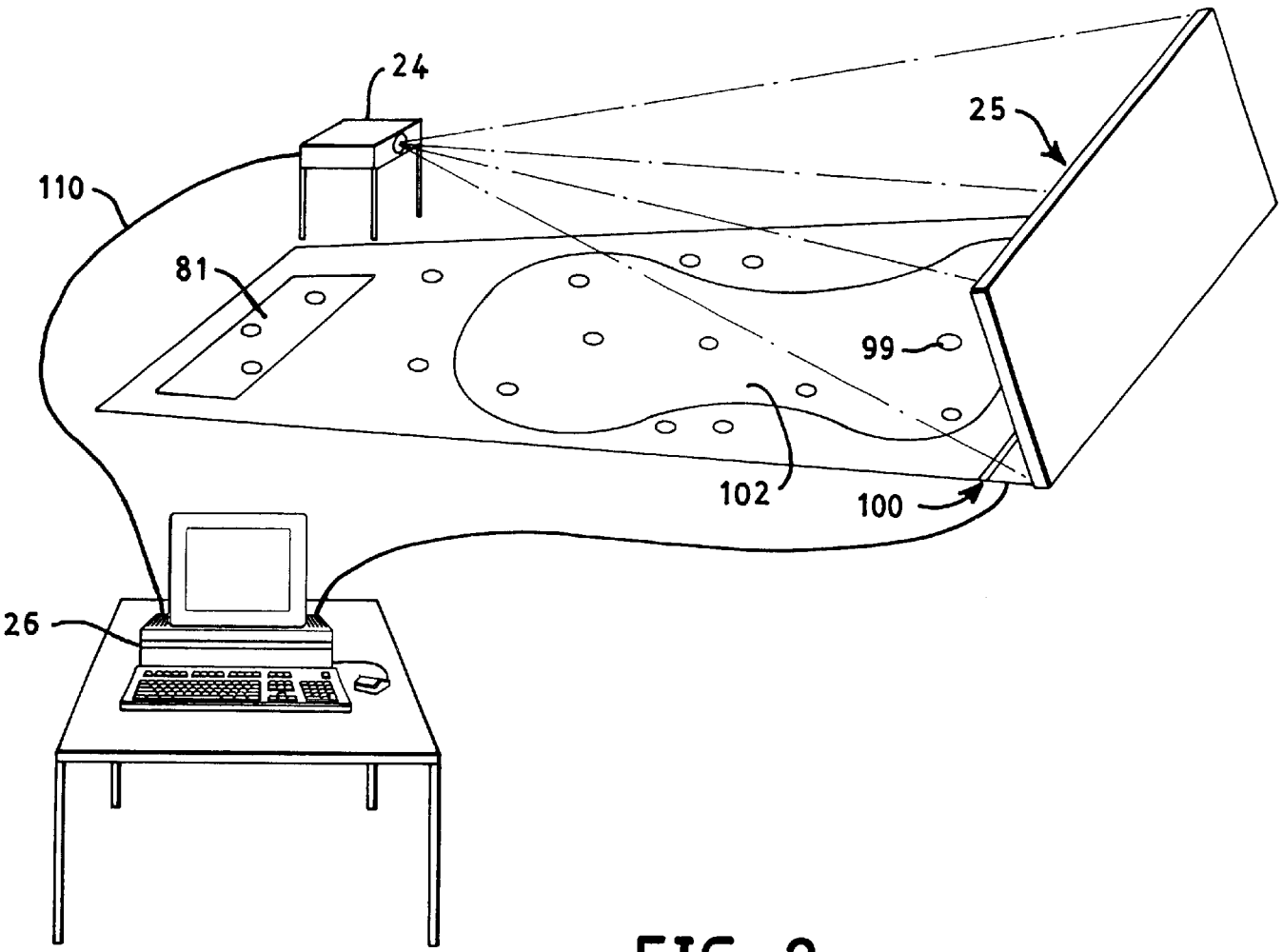
FIG. 2 is an isometric view of the golf simulator.

Referring now to FIG. 2, an isometric view of the golf simulator, and the projection system are shown. The projection system is comprised of a projector 24 and projection screen 25. Also shown is the computer control system 26 in electronic communication with the projector 24 for showing images on the projection screen 25. The computer control system 26 has an interface and connection cable 110 for sending digital images to the projector 24. It is understood by those skilled in the art that various other means of communication may be used between the various components of the system other than cable connection, such as infrared, radio transmission, or some other such form of communication. One means of creating golf images for the projector 24, is through the use of a simulation program such as "Links" by Access Software, Inc. The software has a plurality of scenes from various courses around the world which can be stored on the computer control system 26 and output to a projector 24.

Figure 3:
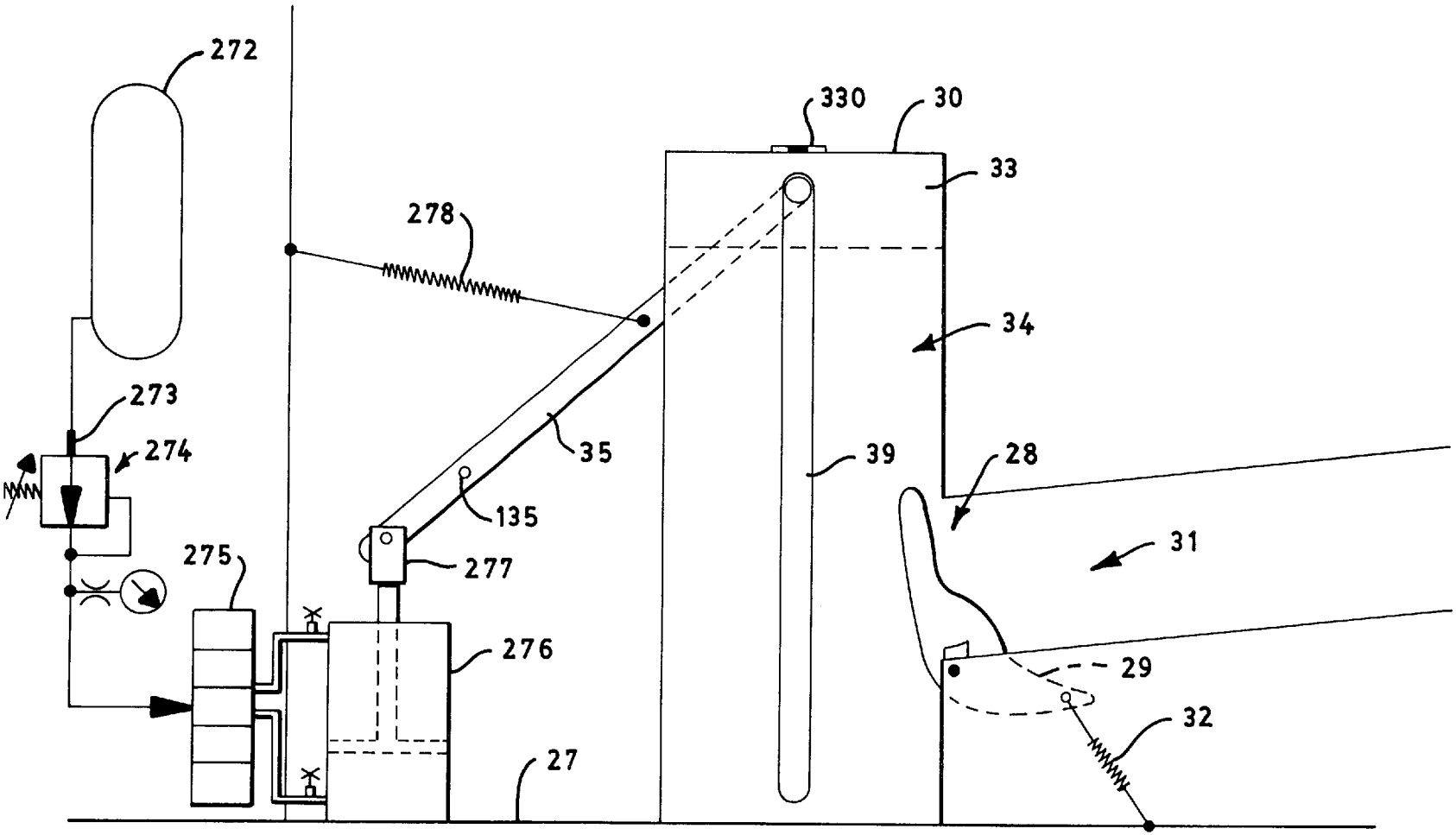
FIG. 3 is an elevation view of the ball lifting mechanism.

Referring now to FIG. 3, an elevation view of the pneumatic ball lifting mechanism 271 is shown. The pneumatic ball lifting mechanism 271 has a compressed air source 272 in flow communication with a coupling 273. The coupling 273 is in flow communication with a pressure regulator 274.

The pressure regulator 274 is in flow communication with a multiple position flow control valve 275. The multiple position flow control valve 275 is in electronic communication with the ball feed system control module 263 and has a plurality of outputs for flow communication with a pneumatic cylinder 276, which is mounted to the housing 27. The pneumatic cylinder 276 houses a slidable piston 277, which is pivotably connected to a second end of linkage 35. The linkage 35 is also pivotably connected to a linkage pin 135, which is connected to the housing 27. A spring 278 is also connected in tension from the housing 27 to the linkage 35 to provide support for the linkage and tee 33.

A tee 33 is pivotably connected to a first end of the linkage 35. The tee 33 is housed within a vertically hollowed area 34 and has at least one pin extending into a tee rail 39 for keeping the tee 33 properly positioned within the vertically hollowed area 34 as it cycles from the ball exit aperture 30 to beneath the ball entrance 28 and back.

The ball lifting mechanism 271 is in supply communication with a ball feeding chute 31. As a golf ball arrives from the feeding chute 31 it must pass a ball entrance gate 29. A ball entrance gate pin 129 pivotably attaches the ball entrance gate 29 to the housing 27. A spring 32 is also attached between the ball entrance gate 29 and the housing 27.

When the compressed air source 272 connected to the ball lifting mechanism 271, the regulator 274 is set to an operating pressure limit, preferably 50 psi. Once the pressure is set, the ball feed system control module 263 controls the flow of compressed air by controlling the multiple position flow control valve 275. In one position, the flow causes the piston 277 to retract, in turn causing the tee 33 to be in its normal position. The opposite flow causes the piston 277 to extend which causes linkage 35 to pivot about the linkage pin 135. As the linkage pivots, the tee 33 is lowered through the vertically hollowed area 34.

Figure 3A:
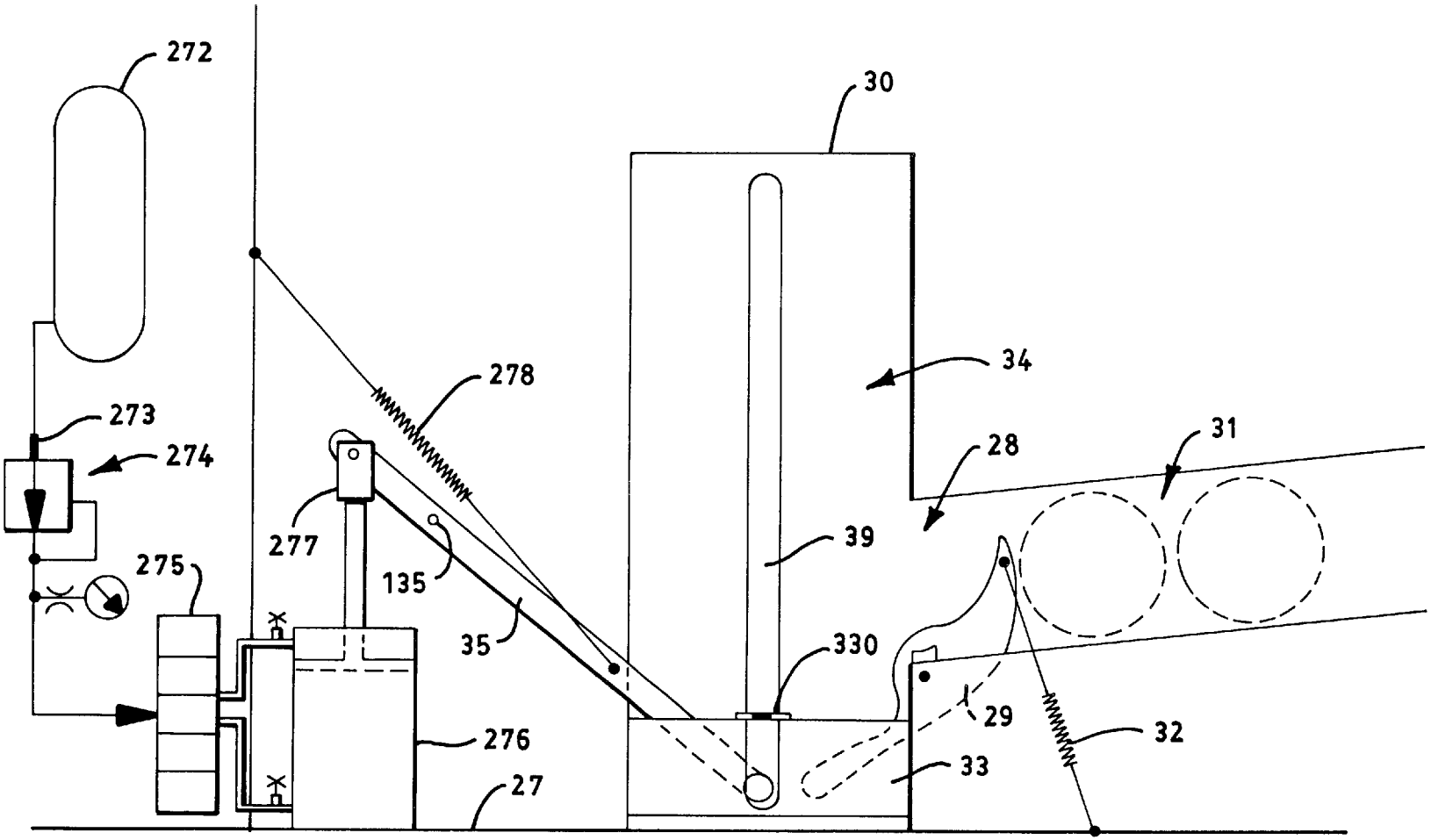
FIG. 3*a* is an elevation view of the ball lifting mechanism in the downward position.

As the tee 33 moves through the vertically hollowed area 34, the linkage 35 engages the ball entrance gate 29, which pivots about the ball entrance gate pin 129. As the ball entrance gate 29 pivots, a golf ball moves from the feeding chute 31 onto the tee 33. Next the ball feed system control module 263 changes position of the multiple position flow control valve 275 causing the piston 277 to retract. As the piston 277 retracts the linkage 35 pivots and the tee 33 raises the ball through the ball exit aperture 30. The upward movement of the tee 33 is dampened so that the ball stays on the tee when it gets to its stopping position through the ball exit aperture 30. Moreover, as the tee 33 raises through the vertically hollowed area 34, the ball entrance gate 29 is returned to its original position which stops balls coming from the ball feeding chute 31. FIG. 3*a* shows the ball lifting mechanism 271 in the downward position.

Figure 3B:
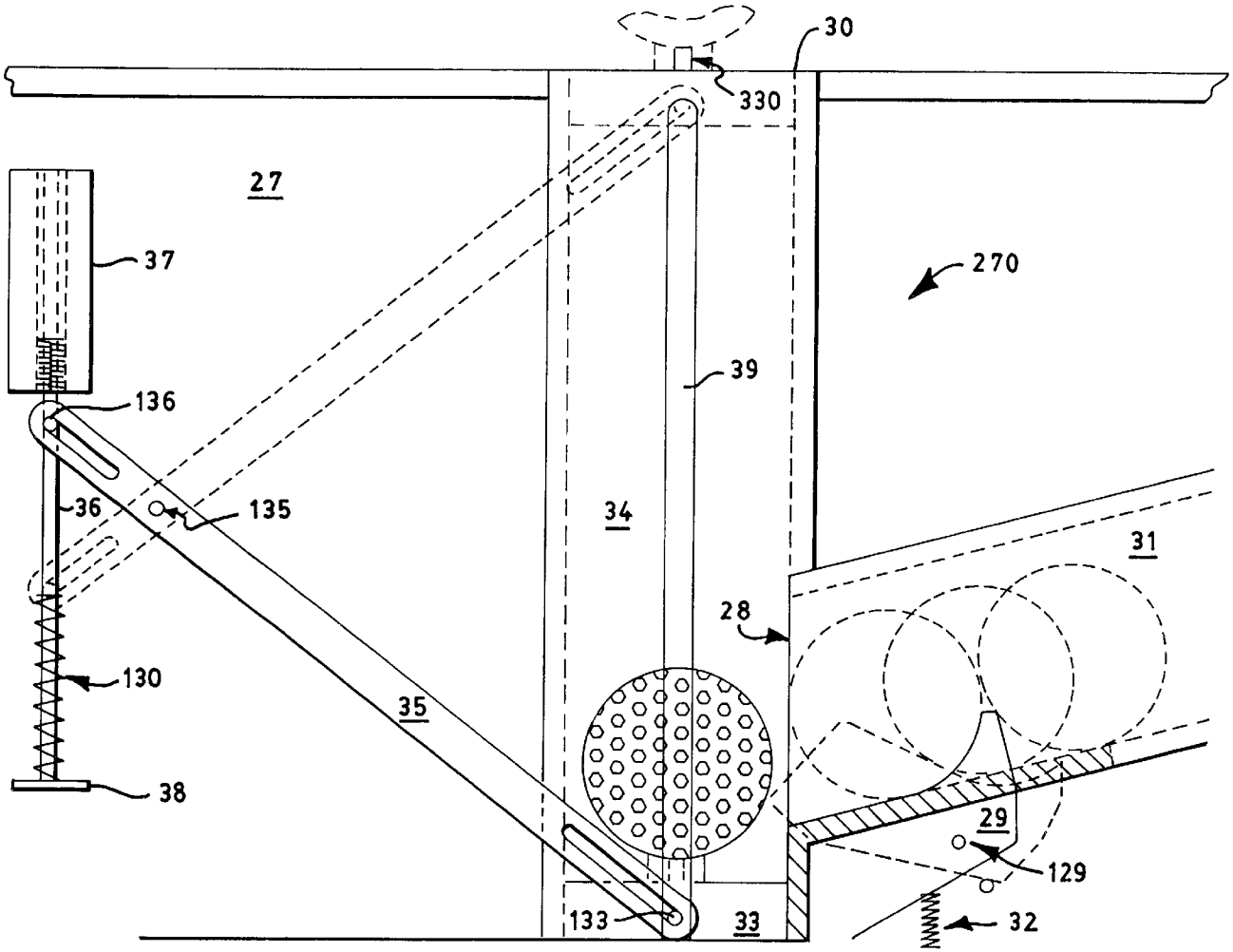
FIG. 3*b* is an elevation view of an alternate embodiment of the ball lifting mechanism.

Referring now to FIG. 3*b*, an alternative embodiment of the ball lifting mechanism 270 is shown. Each tee 33 has a corresponding ball lifting mechanism 270 having a ball feeding chute 31 and a ball exit aperture 30. A golf ball arrives from the feeding chute 31 and passes the ball entrance gate 29. The ball entrance gate 29 is pivotably attached by a ball entrance gate pin 129 to the housing 27 and is biased by a spring 32. As a tee 33 is lowered to accept a ball from the feed chute 31, the tee 33 contacts the ball entrance gate 29. The ball entrance gate 29 lowers because of downward contact from the linkage 35 as it passes to a lower position beneath the ball entrance 28.

The tee 33 which is normally positioned at the top of a vertically hollowed area 34 within the housing 27, is slidably connected to the linkage 35 and moves within the vertically hollowed area 34 from beneath the ball entrance 28 to the ball exit aperture 30. The tee 33 is further slidably connected to a tee rail 39 by a pin and channel connection 133 which keeps the tee in a correct position as it moves between the ball entrance 28 and ball exit aperture 30. Once the tee 33 is lowered beneath the ball entrance 28, the golf ball is seated on the tee 33 and subsequently it is raised to the floor level of the flooring system 103 for hitting.

The linkage 35, which is slidably connected at a first end to a tee 33, is also slidably connected, at a second end, to a guide rod 36 by a pin and channel connection 136. The linkage 35 is also pivotably attached to the housing 27 at a linkage pin 135 to facilitate the movement of the golf tee from below the ball entrance 28 to the ball exit aperture 30.

The guide rod 36 has a first end connected to a solenoid 37. A second end of the guide rod is connected to a spring seat 38. A spring 130 is positioned between the spring seat 38 and a slidable connection of the second end of the linkage 35 to the guide rod 36. In this arrangement the normal position of the tee 33 is maintained at the ball exit aperture 30.

Referring now to FIG. 4, a plan view of the flooring system 103 is shown including the return chute 100, the return gutter 40, and a plurality of feeding tubes 41, 42, 43, 44, 45, 46, 47, 48, 49, 50, 51, 52, 53, 54, 55, 56, and 57. When a player takes a shot, the ball is deflected from the projection screen 25 into the return chute 100, which is disposed in such a manner that gravity causes the ball to travel toward the center of the return chute 100. The golf ball is then directed toward the return gutter 40. Once in the return gutter 40, the ball travels parallel to the length of the flooring system 103. Next the golf ball is directed into one of a plurality of feeding tubes which delivers the golf ball to an appropriate tee based on the results of the prior shot.

Figure 5:
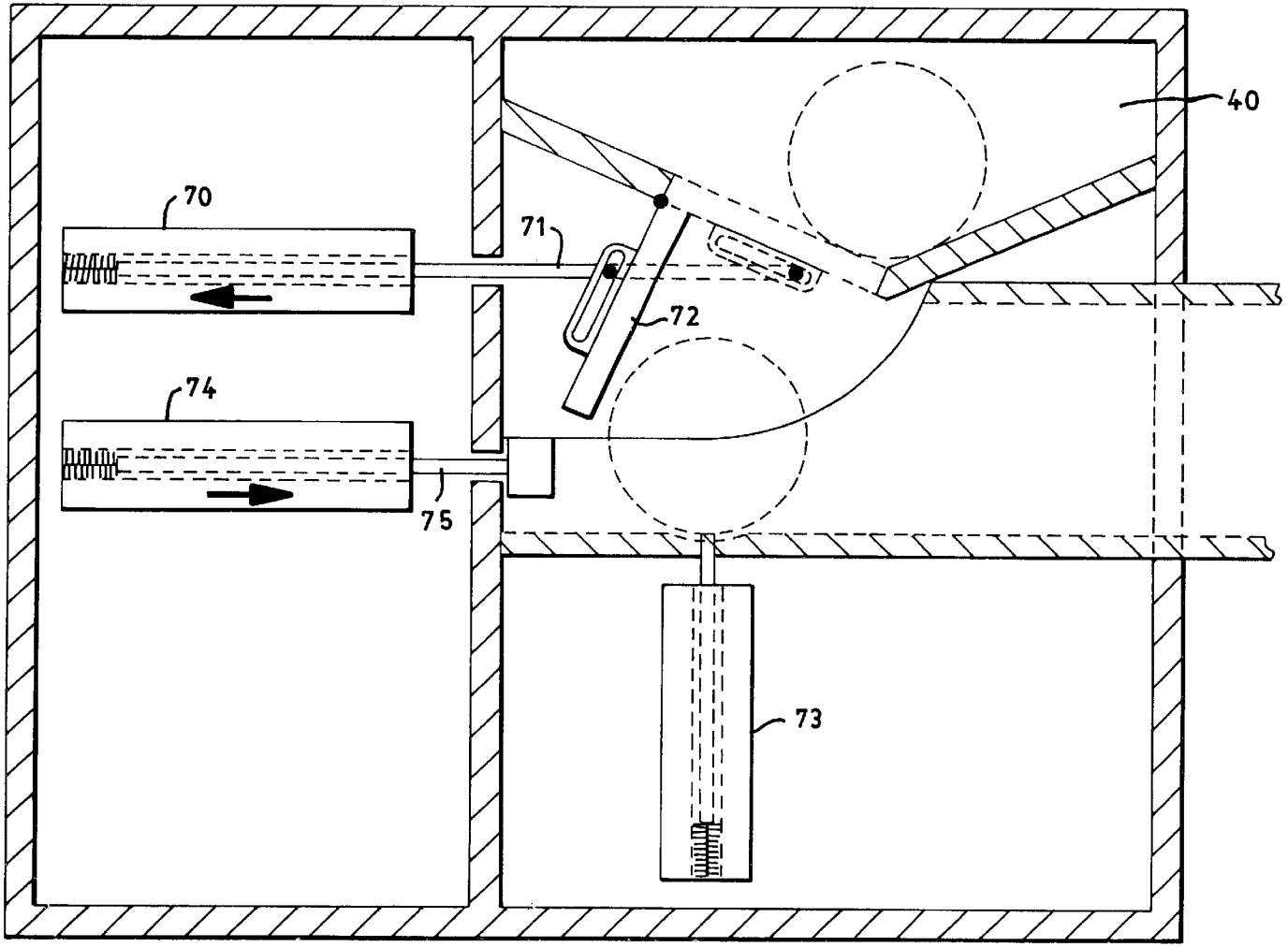
FIG. 5 is an elevation view of a portion of the ball feed system.
Figure 6:
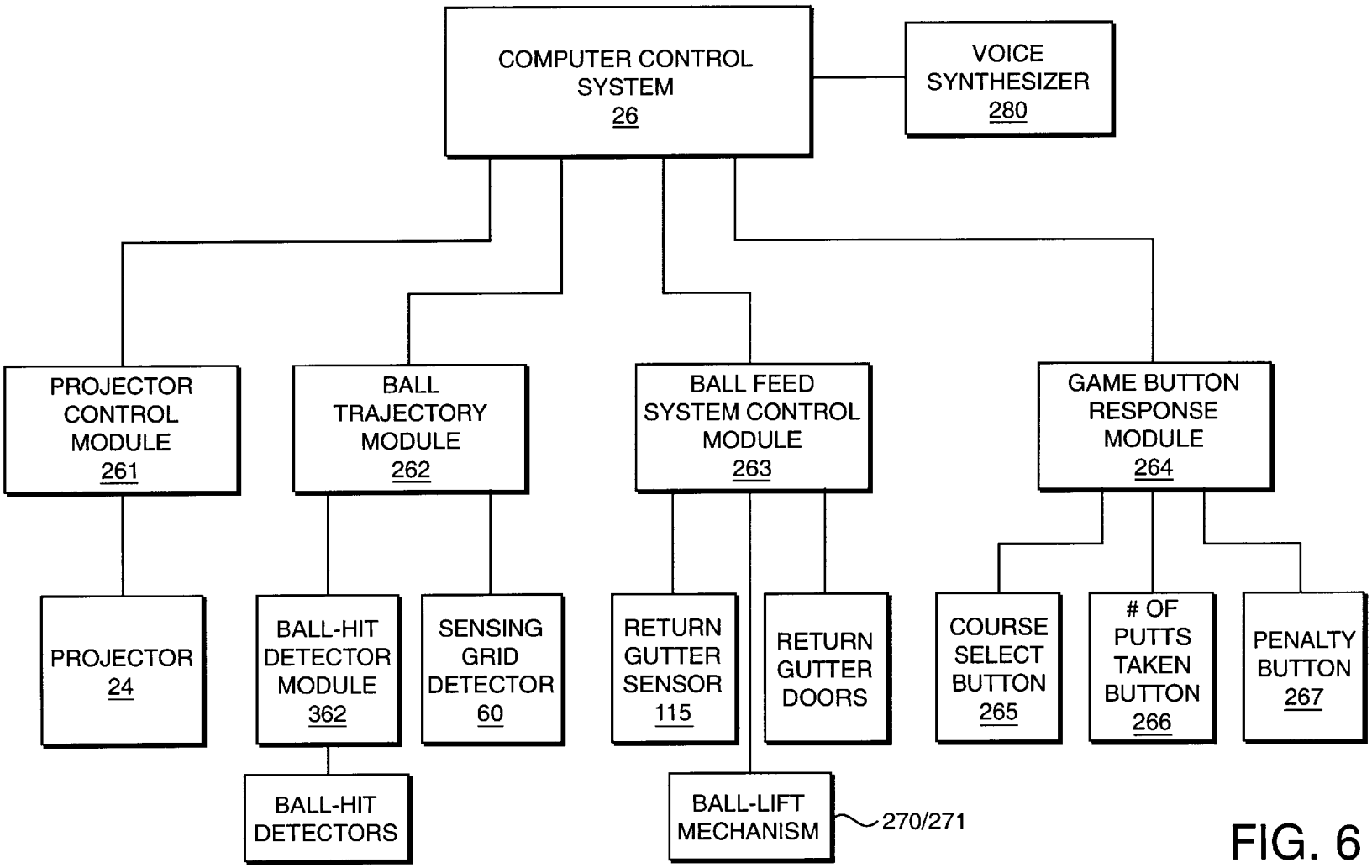
FIG. 6 shows the control systems involved with the golf simulator.
Figure 7A:
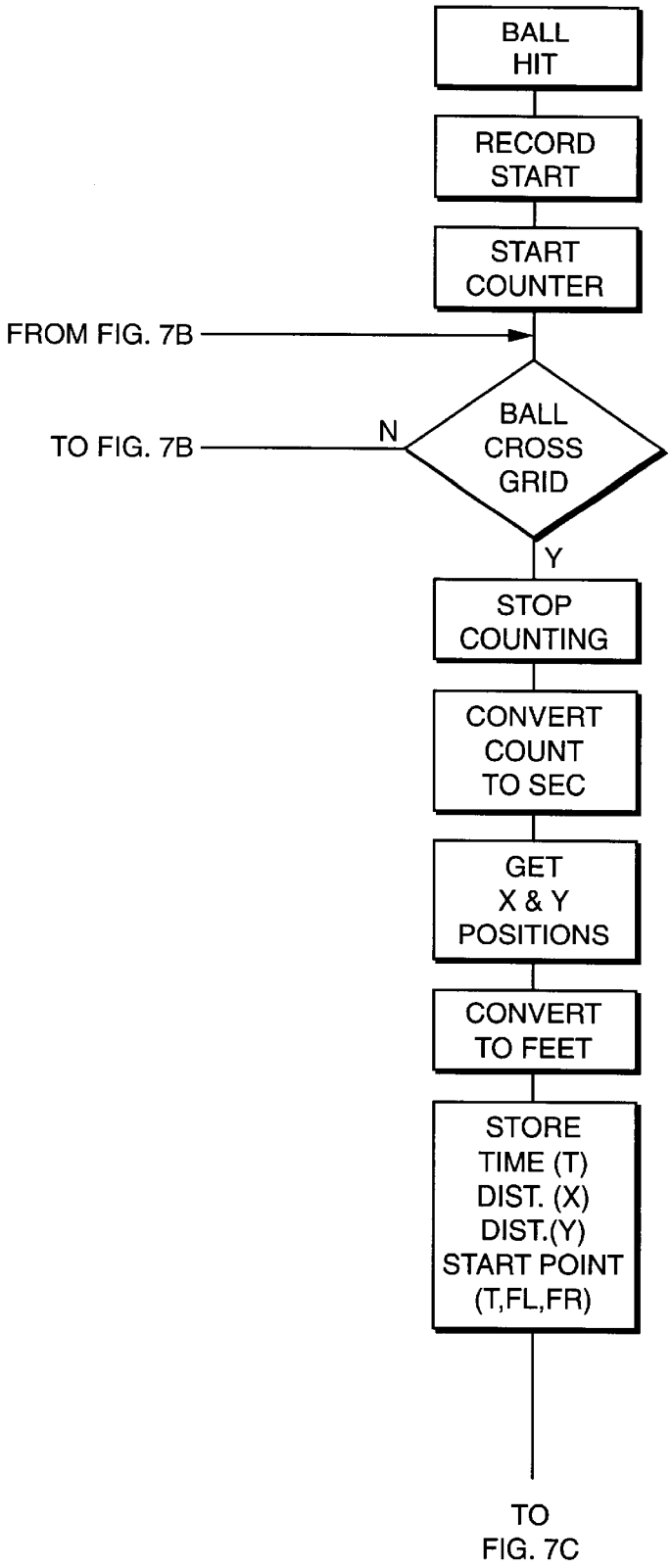
FIG. 7 is a logic flow chart showing how the components interact to control the golf simulator.
Figure 7B:
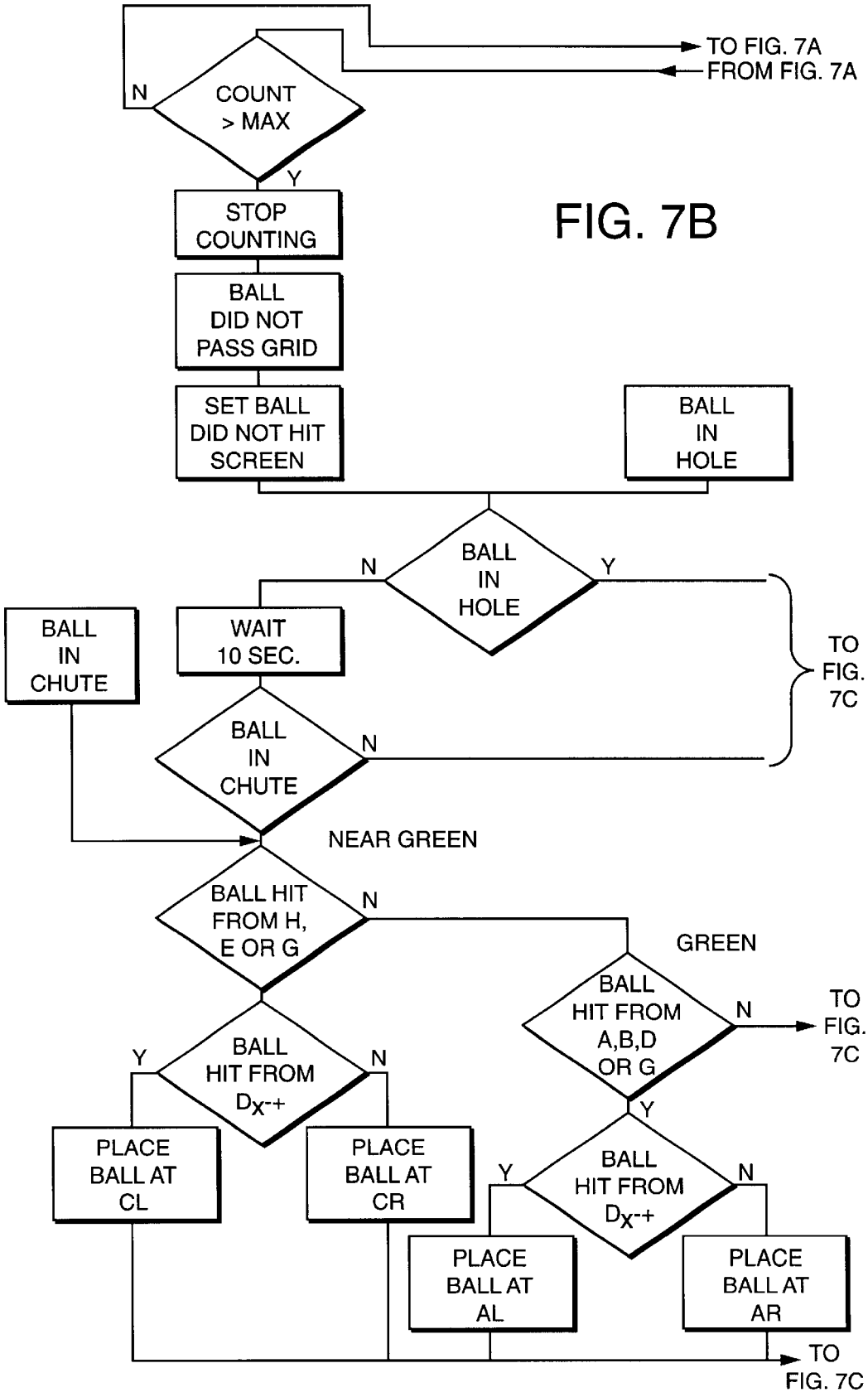
Figure 7C:
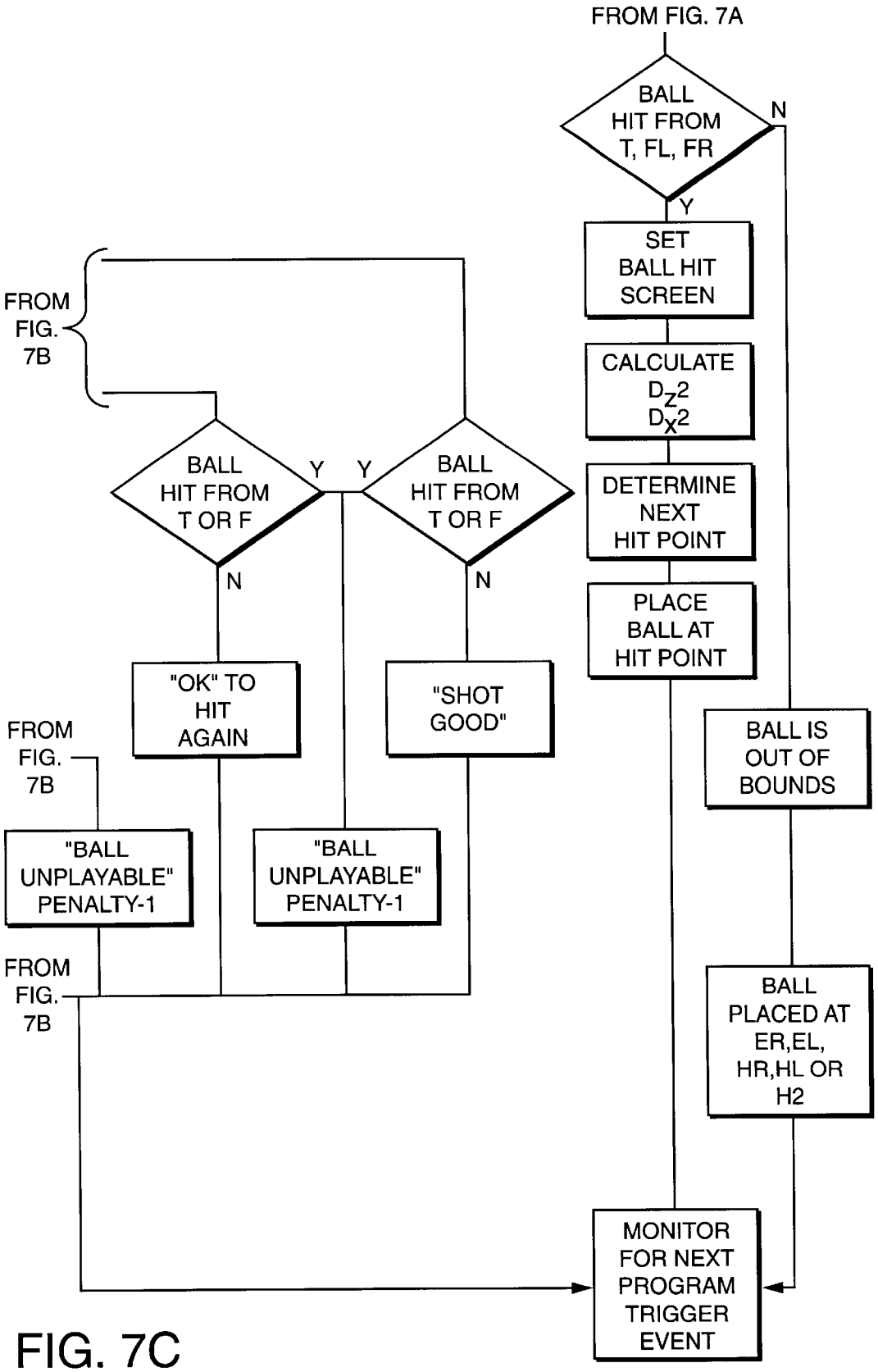

A plurality of ball direction systems are used to move a golf ball from the return gutter 40 to an appropriate feeding tube. The computer control system 26 also contains a ball feed system control module 263, as shown in FIG. 6, which ensures that the golf ball returns to the appropriate tee location for a subsequent shot. Within the return gutter 40 is a gutter sensor 115 that communicates, to the ball feed system control module 263, the location of the golf ball within the return gutter 40. The gutter sensor 115 can be either a spring-switch or light source/photo-detector type sensor. Throughout the return gutter 40 are a plurality of return gutter doors, for example 72 as shown in FIG. 5, each corresponding to and in communication with the plurality of feeding tubes 41, 42, 43, 44, 45, 46, 47, 48, 49, 50, 51, 52, 53, 54, 55, 56, and 57. The return gutter doors, for example 72, are hingably attached to the return gutter 40 such that when a ball passes over the gutter sensor 115 the computer control system 26 is signaled and the ball feed system control module 263 communicates to open an appropriate door, for example 72, corresponding to the tee location that a ball is needed. The door actuator 70 is slidably attached via linkage 71 to the return gutter door 72 and opens the door 72 thereby allowing the ball to drop onto a ball sensor 73. The ball sensor 73 signals a ball pusher 74 which extends a push arm 75 depending from the ball pusher 74 to direct the golf ball into an appropriate feeding tube, for instance, 46 all determined by the ball feed system control module 263. The door actuator 70 and the ball pusher 74 can be either solenoids or pneumatic air cylinders. From the feeding tube, the golf ball is directed into the ball lifting mechanism 27 and up to the floor level 103 for hitting.

The computer control system 26 is comprised of various control modules including a projector control module 261, ball trajectory module 262, ball feed system control module 263, and a game button response module 264. These modules allow the computer control system 26 to communicate with various systems of the golf simulator. The ball trajectory module 262 of the computer control system 26 is connected to and electronically communicating with the ball trajectory system which is comprised of the sensing grid detector 60 and a ball hit detector module 362 which in turn communicates to the plurality of ball hit detectors, for example 330 as shown in FIG. 3.

Each ball-hit detector is comprised of a light source and photo-detector and is located in each of the green tees, green side tees, fairway approach tees and tee shot tees. Each ball-hit detector communicates with the ball hit detector module 362, which in turn communicates to the ball trajectory module 262 when a shot has been taken. The computer control system 26 then begins measuring parameters for determining the final position of the golf shot as well as maintaining a player's score.

The sensing grid detector 60, shown in FIG. 3, is also used to predict the final position of a golf shot and may consist of a plurality of vertically and horizontally spaced light sources and corresponding photo-detectors. When a ball breaks a light beam between a source and photo-detector a signal is sent to the ball trajectory module 262. When the sensing grid detector 60 communicates to the ball trajectory module via an interface card or some such electronic communication means, the computer control system 26 estimates the trajectory and computes an estimated next golf shot position of the golf ball.

In place of, or in addition to, the ball hit detectors and the sensing grid detector 60, a secondary measuring system may also be used in communication with the ball trajectory module 262 of the computer control system 26. The secondary measuring system may have means for measuring initial velocity of the tee shot, direction of the shot, and spin of the golf ball. The measuring system will be located adjacent the flooring system 103 of the simulator. One such measuring systems is described in U.S. Pat. No. 5,390,927. A system such as the one described in the above patent may be used and could be connected to the ball trajectory module via an interface card or some such electronic communication means known in the art.

The game button response module 264 is also shown in FIG. 6. The game button response module 264 is in electronic communication with the game button system. The game button system is comprised of at least three buttons. The course select button 265 is used to select the golf course to be played. The putting button 266 is used to enter the number of putts taken other than from a putting tee. The penalty button 267 is a penalty button which is pushed each time a ball becomes unplayable or out of bounds. The game button system is in electronic communication with the game button control module 264 and allows the computer to start the game as well as keep proper score.

Finally, a voice synthesizer 280 is shown in FIG. 6. The voice synthesizer receives information from the computer control system such as hole number, distance of shot, and shot number, and total score. The voice synthesizer 280 then communicates the information to the player so that the player knows the necessary information during the course of a golf hole.

In order to position a golf ball in a location for hitting, several steps are used. First, a ball is positioned on the tee area 81 for hitting a first shot. When the ball hit detector 362 detects that a shot has been made, the ball trajectory module obtains characteristics from the sensing grid detector 60, and communicates to the computer control system 26. The computer control system 26 in turn computes the distance, direction, and next golf shot position of the golf shot. The position determined by the computer is translated to a grid system, in which the computer control system 26 divides the golf simulator. The computer control system 26 then causes the ball feed system to position the golf ball at a location within the grid, which is corresponding to the computed next golf shot position. Thus a subsequent shot can be taken from a location on the green area 102, on the green side area 101, or from the tee area 81. Once the ball is positioned on the green area or green side area the ball hit detectors are only used to notify the computer control system 26 that the ball has been hit and the player need not hit at the screen 25 in an attempt to cross the sensing grid detector 60. Thus the player shoots toward the putting hole 99 and the computer control system 26 waits for a signal that the ball has entered the putting hole 99. At that time a player enters the number of shots made toward the putting hole on the game button system.

The golf simulator can also determine when a hole in one has been made. If a player hits a tee shot which is calculated to rest within the grid corresponding to the putting hole 99 location, the system records this shot as a hole in one.

The invention may be embodied in various forms without departing from its spirit and essential characteristics. The described embodiments are not to be considered as restrictive. All changes which come within the meaning and range of the claims are to be embraced within the scope.

We claim:

1. A golf simulator comprising:

a flooring system having a tee area adjacent a green area, a green-side area adjacent said green area, and a ball feed system adjacent said flooring system;

said ball feed system comprising a ball direction system, a plurality of multidirectional feeding tubes and a plurality of ball lifting mechanisms;

wherein each of said bail lilting mechanism includes a housing, said housing comprising a ball entrance depending from said feeding tubes, a vertically hollowed area within said housing accepting balls onto a tee, said tee containing a ball-hit detector;

wherein said ball lifting mechanism includes a linkage having first and second ends, said first end slidably connected to said tee, said linkage also being pivotably connected to said housing;

said linkage being spring biased whereby a second end of said linkage is normally positioned lower than a first end of said linkage thereby positioning said tee at said ball exit;

wherein said ball lifting mechanism includes an actuator pivotably connected to said second end of said linkage.

2. The golf simulator of claim 1, wherein said tee area is further comprised of a tee shot tee and at least one fairway approach shot tee.

3. The golf simulator of claim 1, wherein said green-area is further comprised of a plurality of putting tees.

4. The golf simulator of claim 1, wherein said green side area is further comprised of a plurality of chip shot tees.

5. The golf simulator of claim 1, further comprising a projection system, said projection system having a projector located adjacent a flooring system and a projection screen opposite said tee area.

6. The golf simulator of claim 1, further comprising a ball trajectory system, said ball trajectory system having a plurality of ball hit detectors and a sensing grid detector located opposite said tee area substantially adjacent said projection screen.

7. The golf simulator of claim 1, wherein said ball lifting mechanism further campuses a ball entrance gate located adjacent said ball entrance, said ball entrance gate being spring biased and pivotably attached to said housing.

8. The golf simulator of claim 1, wherein said tee is positioned within said vertically hollowed area for movement between said ball entrance and a ball exit aperture.

9. The golf simulator of claim 1, wherein said ball lifting mechanism further comprises a tee rail, said tee rail vertically positioned within said vertically hollowed area and slidably connected to said tee such that said tee maintains correct alignment during movement in said vertically hollowed area.

10. The golf simulator of claim 1, where said actuator is a pneumatic air cylinder.

11. The golf simulator of claim 1, where said actuator is a solenoid.

12. The golf simulator of claim 10, where said actuator is a solenoid.

13. The golf simulator of claim 12, where said solenoid is in electronic communication with a power source.

14. The golf simulator of claim 1, further comprising a computer control system, said computer control system comprising a projector control module, a ball trajectory module, a ball feed system control module, a game button response module and a voice synthesizer.

15. The golf simulator of claim 14, further comprising, a game button system comprising at least one button for controlling said golf simulator and maintaining score.

16. The golf simulator of claim 14, wherein said projector control module is in electronic communication with said projector, said ball feed system control module is in electronic communication with said ball feed system, said ball trajectory module is in electronic communication with said ball trajectory system, and said game button response module is in electronic communication with said game button system.

17. The golf simulator of claim 14, wherein said projector control module is comprised of an interface for said projector and control software and hardware.

18. The golf simulator of claim 14, wherein said ball trajectory module is comprised of an interface and control software and hardware.

19. The golf simulator of claim 1, wherein said ball lilting mechanism further comprises:

a guide rod having first and second ends depending from a solenoid, said first end slidably connected to a solenoid, said second end having a spring seat; and, a spring disposed between said spring seat and a slidable connection to said second end of said linkage.

20. A ball feed system comprising:

a ball return chute substantially adjacent a flooring system, a return gutter adjacent said flooring system and connected to said ball return chute;

a plurality of ball direction systems in communication with said return gutter for directing a golf ball into a feed tube;

wherein said ball direction system includes a plurality of return gutter doors hingeably attached to said return gutter, a door actuator slidably attached to said return gutter door, a ball pusher, substantially beneath said actuator, a ball sensor substantially beneath said return gutter door, and a ball feed tube depending from each of said plurality of ball direction systems;

wherein said door actuator is selected from the group consisting of a pneumatic air cylinder and a solenoid.

21. The ball feed system of claim 20, where said ball pusher is selected from the group consisting of a pneumatic air cylinder and a solenoid.

22. A golf simulation comprising the steps of:

a. hitting a golf shot from a tee;

b. detecting said golf shot hit from a tee;

b. computing the distance and direction of said golf shot;

c. computing a next golf shot position based on said golf shot;

d. translating said next golf shot position to a grid system;

e. determining if computed said next golf shot position is located at a putting hole location; and f. positioning a golf ball at a location within said grid system corresponding to computed said next golf shot.

* * * * *